US006039315A

United States Patent [19]

Lim

[11] Patent Number: 6,039,315

[45] Date of Patent: Mar. 21, 2000

[54] UNIVERSAL PAPER CASSETTE

[75] Inventor: Kwang-taek Lim, Kwangmyung, Rep. of Korea

[73] Assignee: Samsung Electronics Co., Ltd., Kyungki-do, Rep. of Korea

[21] Appl. No.: 09/118,817

[22] Filed: Jul. 20, 1998

[30] Foreign Application Priority Data

Aug. 30, 1997 [KR] Rep. of Korea ..... 97-44420

[51] Int. Cl.[7] ..... B65H 1/10

[52] U.S. Cl. ..... 271/160; 271/171; 271/127

[58] Field of Search ..... 271/171, 127, 271/160

[56] References Cited

U.S. PATENT DOCUMENTS 5,815,787 9/1998 Crayton et al. ..... 271/171

FOREIGN PATENT DOCUMENTS 404106026 4/1992 Japan ..... 271/171

404313523 11/1992 Japan ..... 271/160

405069955 3/1993 Japan ..... 271/160

*Primary Examiner*—H. Grant Skaggs

*Attorney, Agent, or Firm*—Sughrue, Mion, Zinn, Macpeak & Seas, PLLC

[57] ABSTRACT

A universal paper cassette for feeding paper sheets comprising a case, a pair of side guide members installed within the case to be parallel to the side walls of the case and to be slidable widthwise according to the width of the paper sheets for supporting both sides of received paper sheets, finger members assembled to the respective side guide members to move together therewith, a lengthwise guide member installed within the case to be slidable lengthwise according to the length of the paper sheets for supporting the front ends of the paper sheets, a paper pressing plate assembled to both sides of the case by pins to vertically pivot, and at least one spring installed within the case for elastically biasing the paper pressing plate upward. The universal paper cassette further comprises an elastic unit for connecting the side guide members or the lengthwise guide member with the paper pressing plate and controlling an elastic force against the paper pressing plate.

10 Claims, 5 Drawing Sheets

UNIVERSAL PAPER CASSETTE

BACKGROUND OF THE INVENTION

1. Field of the Invention

The present invention relates to a universal paper cassette for receiving sheets of paper for a printer, a copier, or the like, and more particularly, to a universal paper cassette in which the pressing force of a paper pressing plate can be controlled.

2. Description of the Related Art

In general, a printing device such as a printer or a copier is provided with a universal paper cassette for receiving sheets of paper and sequentially feeding the received sheets of paper into a main body of the printing device. A cassette constructed to receive a certain size of paper sheets or a universal paper cassette constructed to receive various paper sizes with one case is used as a case for receiving paper.

FIG. 1 is a partially cut away perspective view schematically showing a conventional universal paper cassette.

Referring to FIG. 1, a conventional universal paper cassette is provided with a case 10, a pair of side guide members 14 installed within the case 10 to be slidable widthwise according to the width of received paper sheets for supporting both sides of the received paper sheets, a lengthwise guide member 16 installed within the case 10 to be slidable lengthwise according to the length of the paper sheets for supporting the front ends of the paper sheets, a pair of finger members 17 extending from each side guide member 14 for pressing and supporting both rear corners of the paper sheets, and a paper pressing plate 12 on which the paper sheets are laid. The paper pressing plate 12 is pivotally connected to the sides of the case 10 by pins P. Further, springs 18 which press the paper pressing plate 12 upward are installed under the paper pressing plate 12. In addition, since racks 15 are installed at each of the side guide members 14, and a pinion (not shown) is interposed between the racks 15 and meshes with the racks 15, the sliding movement of the side guide members 14 can be guided.

In order to load paper sheets of a desired size into a conventional universal paper cassette as described above, a user separates the side guide members 14 wide enough to lay the paper sheets on the paper pressing plate 12. At this time, the finger members 17 move together with the respective side guide members 14. After loading the paper sheets, the user adjusts the side guide members 14 in the direction indicated by arrow B to closely contact and support both sides of the paper sheets. Also, while the lengthwise guide member 16 is adjusted in the direction indicated by arrow A to support the front ends of the paper sheets, the front ends of the paper sheets are adjusted to be aligned with the front end of the paper pressing plate 12 and the rear end portions of the paper sheets must be interposed between the paper pressing plate 12 and the finger members 17. The sheets of paper so positioned as described above stay ready for use while being pressed against the finger members 17 by the elastic force of the spring 18 under the paper pressing plate 12. In order to use paper sheets of another size, after a user removes paper sheets having been in use from the case 10 and lays the paper sheets to be used on the paper pressing plate 12, the user adjusts the side guide members 14 and the lengthwise guide member 16 as described above, and thereby the change of paper sheets is completed.

However, the conventional universal paper cassette as described above has a disadvantage in that the objective of the universal paper cassette for using various sizes of paper sheets is not effectively achieved. That is to say, since the elastic force of each spring 18 is constant, an appropriate elastic force cannot be exerted according to variations in the size of paper sheets. In other words, when a larger size paper sheet is used, the weight of the paper sheets increases. Therefore, the elastic forces of the springs 18 exerted on the paper pressing plate 12 is decreased due to the weight of the paper sheets and a pressing force between the finger members 17 and the paper pressing plate 12 is decreased. On the contrary, when a smaller size paper sheet is used, the elastic forces of the springs 18 exerted on the paper pressing plate 12 is increased and a pressing force between the finger members 17 and the paper pressing plate 12 is increased. Therefore, paper jams in which more than two paper sheets are fed at a time may occur in the main body of a printing device.

SUMMARY OF THE INVENTION

To solve the above problem, it is an objective of the present invention to provide a universal paper cassette for enhancing the reliability of paper feeding by providing a paper pressing plate in which a constant pressing force can be exerted against various sizes of paper sheets.

Accordingly, to achieve the above objective, there is provided a universal paper cassette including: a case; a paper pressing plate installed in the case to pivot upward or downward for receiving paper sheets on the upper surface thereof; side guide members installed within the case to be slidable widthwise according to the width of the paper sheets for supporting both sides of the received paper sheets; at least one spring installed within the case for elastically biasing the paper pressing plate upward; and an elastic unit for controlling an elastic force against the paper pressing plate in accordance with the movement of the side guide members, the ends of the elastic unit being fixed to the side guide members and the paper pressing plate.

According to another aspect of the present invention, there is provided a universal paper cassette including: a case; a paper pressing plate installed in the case to pivot upward or downward for receiving paper sheets on the upper surface thereof; a lengthwise guide member installed within the case to be slidable lengthwise according to the length of the paper sheets for supporting the front ends of the paper sheets; at least one spring installed within the case for elastically biasing the paper pressing plate upward; and an elastic unit for controlling an elastic force against the paper pressing plate in accordance with the movement of the lengthwise guide member, the ends of the elastic unit being fixed to the lengthwise guide member and the paper pressing plate.

According to still another aspect of the present invention, there is provided a universal paper cassette including: a case; a paper pressing plate installed in the case to pivot upward or downward for receiving paper sheets on the upper surface thereof; a lengthwise guide member installed within the case to be slidable lengthwise according to the length of the paper sheets for supporting the front ends of the paper sheets; at least one spring installed within the case for elastically biasing the paper pressing plate upward; an angular lever installed on the bottom surface of the case to be capable of pivoting around the corner portion thereof and having a first lever portion to which one end of the spring is fixed and a second lever portion, in which an appropriate angle is formed between the first and second lever portions; and an elastic unit for controlling an elastic force against the paper pressing plate by pivoting the angular member in accordance with the movement of the lengthwise guide member, the ends of the elastic unit being fixed to the angular lever and the lengthwise guide member.

BRIEF DESCRIPTION OF THE DRAWINGS

The above objective and advantage of the present invention will become more apparent by describing in detail a preferred embodiment thereof with reference to the attached drawings in which.

DESCRIPTION OF THE PREFERRED EMBODIMENTS

Figure 1:
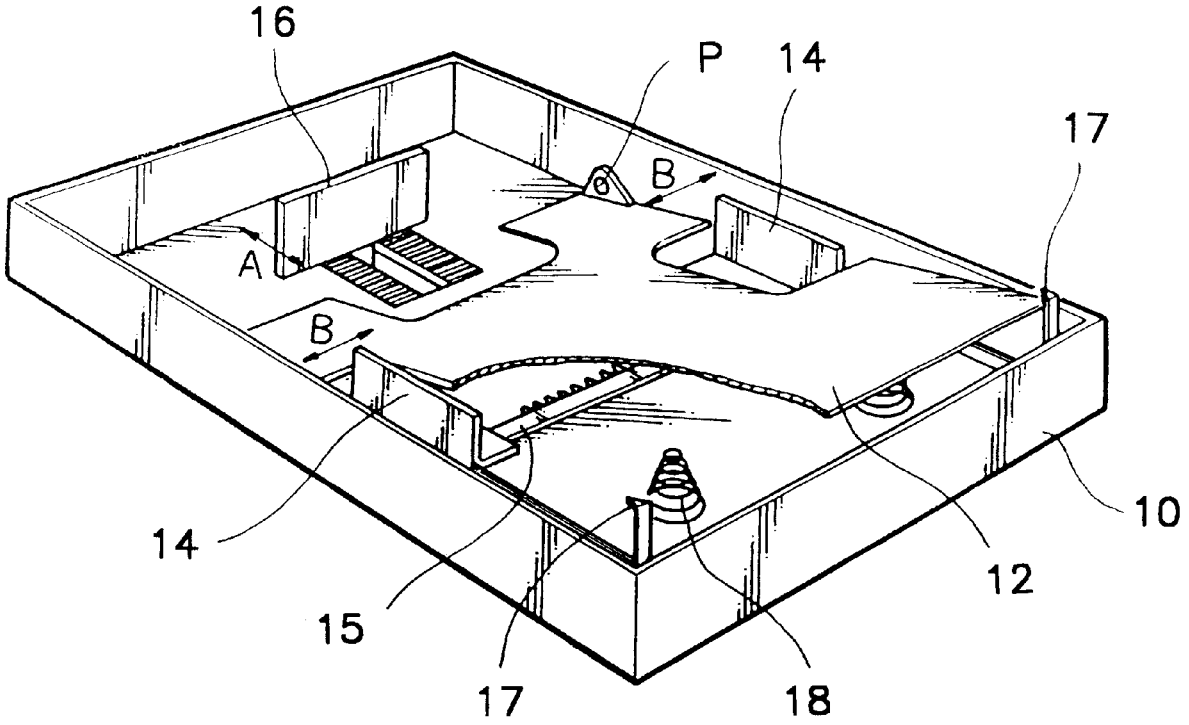
FIG. 1 (PRIOR ART)
FIG. 1 is a partially cut away perspective view schematically showing a conventional universal paper cassette.
Figure 2:
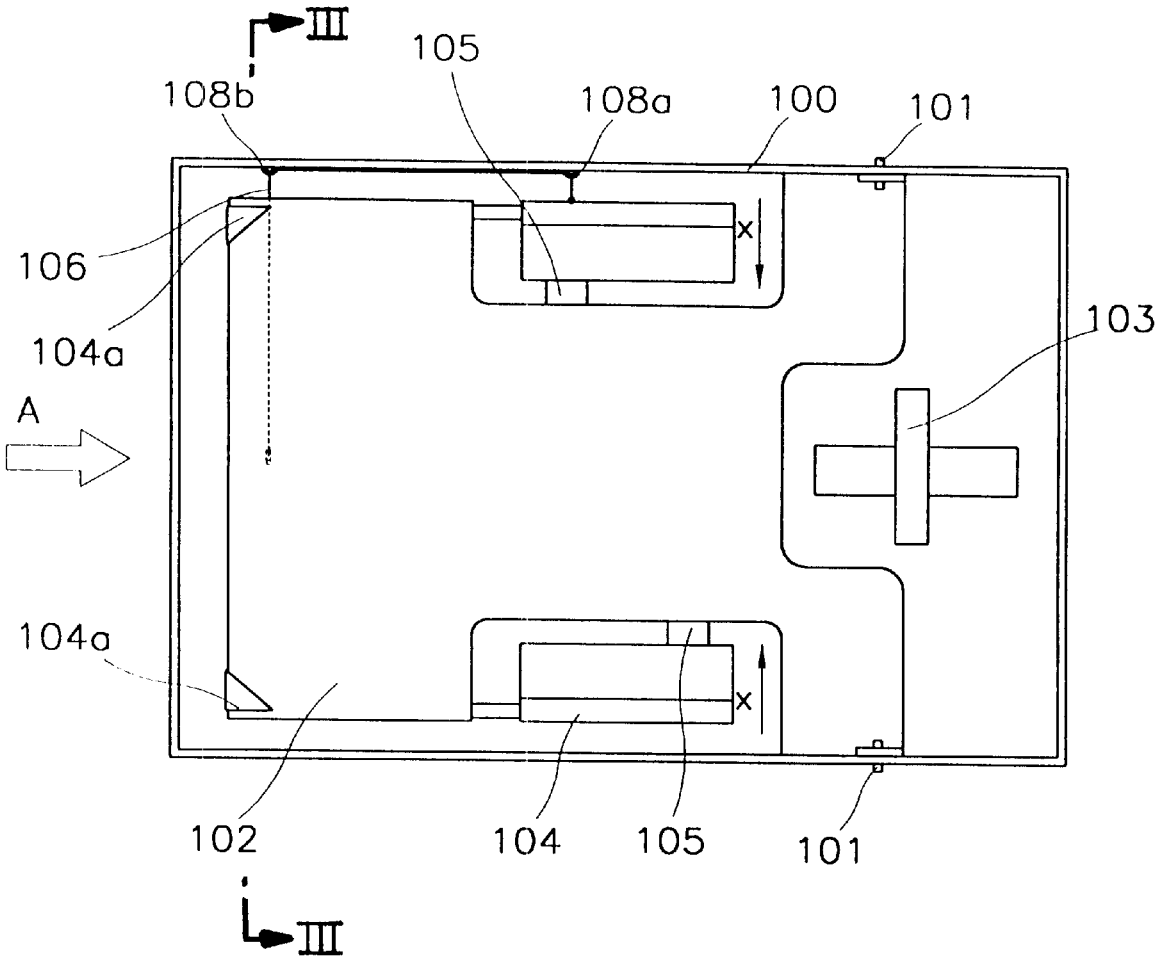
FIG. 2 is a plan view schematically illustrating a portion of a first embodiment of a universal paper cassette according to the present invention.
Figure 3:
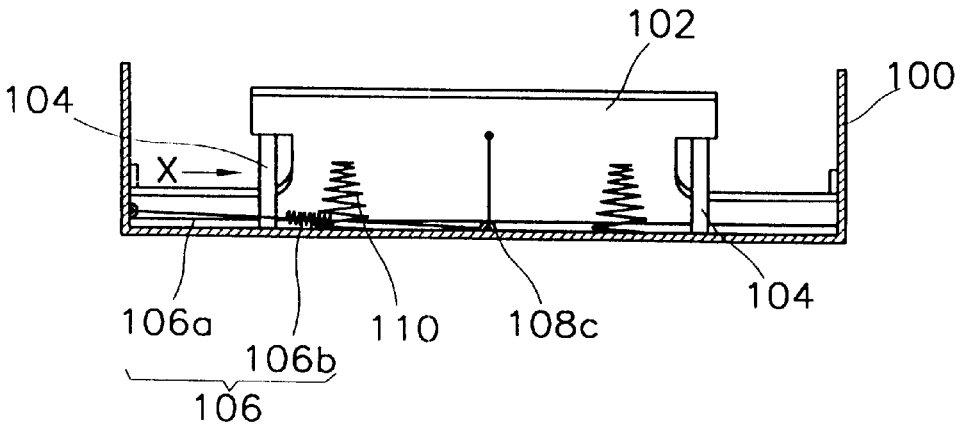
FIG. 3 is a section view of the universal paper cassette according to the present invention taken along the line III—III of FIG. 2.

FIGS. 2 and 3 show a first embodiment of a universal paper cassette according to the present invention.

Referring to FIGS. 2 and 3, a universal paper cassette of the present embodiment includes a case 100, a pair of side guide members 104 installed within the case 100 to be slidable widthwise according to the width of received paper sheets for supporting both sides of the received paper sheets, a lengthwise guide member 103 installed within the case 100 to be slidable lengthwise according to the length of the paper sheets for supporting the front ends of the paper sheets, a paper pressing plate 102 assembled by pins 101 at both inner sides of the case 100 to pivot upward and downward around the pins 101, and springs 110 positioned under the paper pressing plate 102 for pressing it upward. Each side guide member 104 is fixed to a respective rack 105 which meshes with a pinion (not shown), and the lateral movement of the side guide member 104 is guided thereby. The universal paper cassette is further provided with a pair of finger members 104*a* which are respectively extended from the side guide members 104 for pressing and supporting both rear corners of the received paper sheets. The finger members 104*a* are installed to move together with the respective side guide members 104.

According to the present embodiment, the universal paper cassette is provided with an elastic unit 106 for controlling an elastic force against the paper pressing plate 102 in accordance with the movement of the side guide members 104, the ends of which are fixed to the paper pressing plate 102 and the side guide members 104. The elastic unit 106 has a tension spring portion 106*b* and wire portions 106*a*, and one end of the elastic unit 106 is fixed to the lower surface of the paper pressing plate 102 and the other end is fixed to one of the side guide members 104. That is to say, one end of the elastic unit 106 is fixed to the lower surface of the paper pressing plate 102 and the other end is fixed to the side guide member 104 via first, second, and third hooks 108*a*, 108*b* and 108*c* provided at the bottom surface and the inner side surface of the case 100. Therefore, it is preferable that the elastic unit 106 can elastically deform between the first hook 108*a* and the third hook 108*c* in order to control elastic forces of the springs 110. Accordingly, the tension spring 106*b* is preferably disposed between the second hook 108*b* and the third hook 108*c* in the elastic unit 106. In addition, the number of hooks is not limited by the present embodiment, and can be appropriately adjusted so that the elastic unit may connect the paper pressing plate 102 with the side guide member 104.

In a universal paper cassette as described above, when the size of paper sheets to be used is smaller than that of paper sheets being previously used, the side guide members 104 are moved in a direction indicated by arrow X in order to support the sides of the paper sheets to be used. Thus, as the side guide members 104 are moved inward, the elastic force of the elastic unit 106 is accordingly increased. Since the elastic force of the elastic unit 106 acts in a direction opposite to that of the elastic forces of the springs 110, the elastic force of the elastic unit 106 counteracts the elastic forces of the springs 110 against the paper pressing plate 102. In other words, since the upwardly pressing force of the paper pressing plate 102 pressed upward by the springs 110 is diminished by the downward elastic force of the elastic unit 106, the upward pressing force exerted on the paper sheets by the paper pressing plate 102 is consequentially diminished. Therefore, when small paper sheets are used, an excessive pressing force by the paper pressing plate 102 is prevented by narrowing the distance between the side guide members 104 and consequentially diminishing the upwardly pressing force of the paper pressing plate 102.

On the contrary, when large paper sheets are used, the side guide members 104 are moved in an opposite direction of arrow X and the elastic unit 106 is loosened. Accordingly, the upwardly pressing force of the paper pressing plate 102 is increased, thereby further resisting the downward weight of the paper sheets on the paper pressing plate 102. Consequently, since the upward pressing force of the paper pressing plate 102 is proportional to the size of the paper sheets, an appropriate upward pressing force according to the respective size of paper sheets can be provided.

Figure 4:
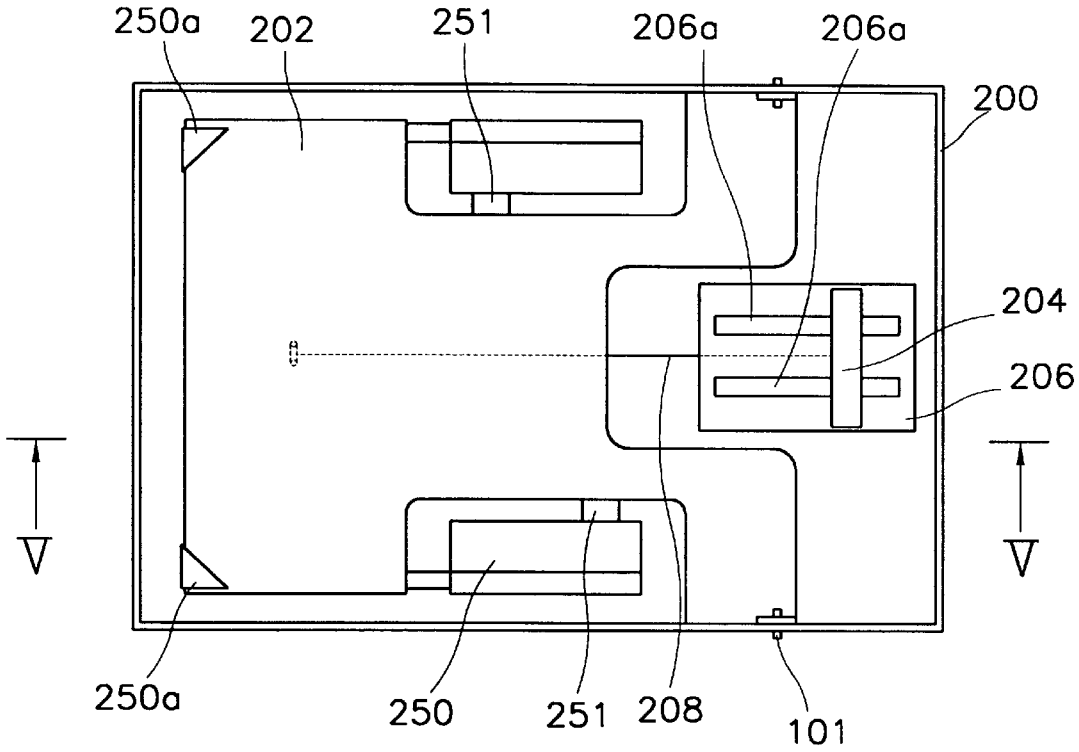
FIG. 4 is a plan view schematically illustrating a portion of a second embodiment of a universal paper cassette according to the present invention.
Figure 5:
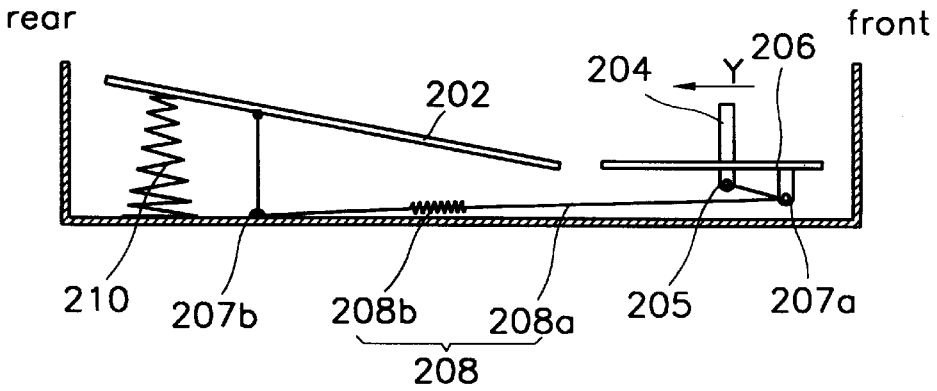
FIG. 5 is a section view taken along the line V—V of FIG.4.

FIGS. 4 and 5 show a second embodiment of a universal paper cassette according to the present invention. The same reference numerals denote similar members having similar functions of FIGS. 2 and 3.

Referring to FIGS. 4 and 5, a universal paper cassette according to the second embodiment includes a case 200, a pair of side guide members 250 installed within the case 200 to be slidable widthwise according to the width of received paper sheets for supporting both sides of the received paper sheets, a lengthwise guide member 204 installed within the case 200 to be slidable lengthwise according to the length of the paper sheets for supporting the front ends of the paper sheets, a plate member 206 provided with two elongated slots into which the lengthwise guide member 204 is fitted for guiding the movement of the lengthwise guide member 204, a paper pressing plate 202 assembled by pins 101 at both inner sides of the case 200 to pivot upward and downward around the pins 101, and springs 210 positioned under the paper pressing plate 202 for pressing the paper pressing plate 202 upward. Each side guide member 250 is fixed to a respective rack 251 which meshes with a pinion (not shown), and the lateral movement of the side guide member 250 is thus guided. The universal paper cassette is further provided with a pair of finger members 250*a* which are respectively extended from the side guide members 250 for pressing and supporting both rear corners of the received paper sheets. On the other hand, in the present embodiment, a separate elastic unit 208 in addition to the springs 210 is provided. The elastic unit 208 has a tension spring portion 208*b* and wire portions 208*a*, one end of the elastic unit 208 is fixed to an eyed leg portion 205 provided at a lower portion of the lengthwise guide member 204, and the other end is fixed to the lower surface of the paper pressing plate 202 via first and second hooks 207*a* and 207*b*. The first and second hooks 207*a* and 207*b* are provided at the lower surface of the plate member 206 and the bottom surface of the case 200, respectively. In addition, the tension spring portion 208*b* is preferably disposed between the first and second hooks 207*a* and 207*b*.

In a universal paper cassette as described above, when the size of paper sheets to be used is smaller than that of paper sheets used previously, the lengthwise guide member 204 is moved in a direction indicated by arrow Y to an appropriate position to support the lengthwise ends of paper sheets. As the lengthwise guide member 204 is moved in the direction indicated by arrow Y, the elastic unit 208 is elongated and the elastic force thereof is increased. Accordingly, since a downward force pulling the paper pressing plate 202 is increased, an upward pressing force of the paper pressing plate 202 against the received paper sheets is decreased. On the contrary, when large paper sheets are used, the lengthwise guide member 204 is moved backward, i.e., in the opposite direction of arrow Y to an appropriate position to support the lengthwise ends of paper sheets. Accordingly, the elastic unit 208 is loosened by an amount corresponding to the displacement of the lengthwise guide member 204, and since the elastic force of the elastic unit 208 counteracting the elastic forces of the springs 210 is decreased, an upward pressing force of the paper pressing plate 202 against the paper sheets is increased.

Figure 6:
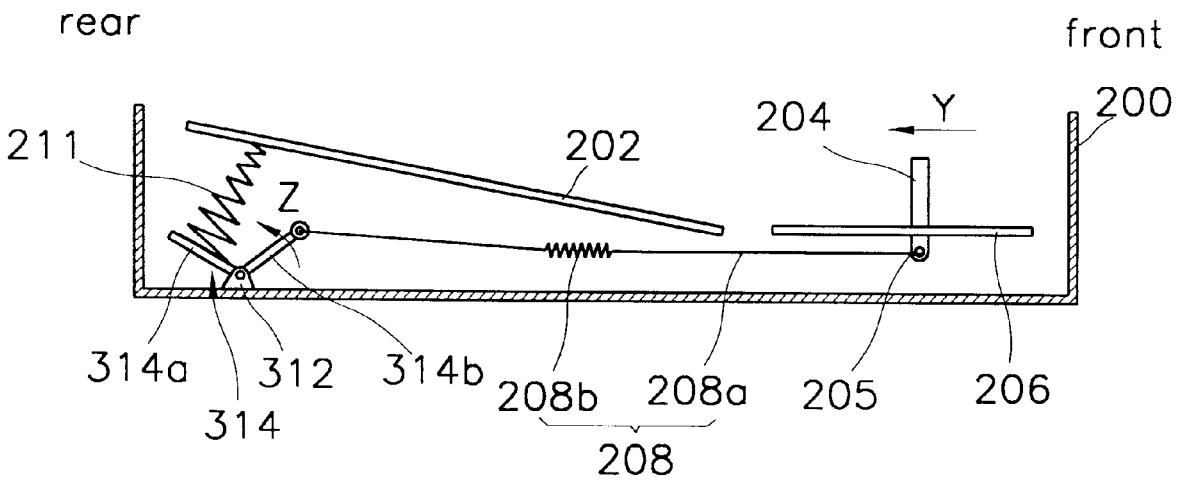
FIG. 6 is a side view schematically illustrating a portion of a third embodiment of a universal paper cassette according to the present invention.

FIG. 6 shows a third embodiment of a universal paper cassette according to the present invention.

Referring to FIG. 6, the third embodiment of a universal paper cassette is similar to the second embodiment described above. The same reference numerals denote similar members having similar functions of FIG. 5.

According to features of the present embodiment, an angular lever 314 generally having an obtuse angle is rotatably installed on the bottom surface of a case 200. That is, the corner portion of the angular lever 314 is pivotally supported by a supporter 312, a spring 211 is disposed between a first lever portion 314*a* of the angular lever 314 and a paper pressing plate 202, and a second lever portion 314*b* is fixed to one end of an elastic unit 208. One end of the elastic unit 208 having a tension spring portion 208*b* and wire portions 208*a* is fixed to an eyed leg portion 205 provided at a lower portion of the lengthwise guide member 204, and the other end is fixed to the leading end of the second lever portion 314*b* of the angular lever 314.

In the present embodiment of a universal paper cassette as described above, when the size of paper sheets to be used is smaller than that of paper sheets being previously used, the lengthwise guide member 204 is moved in a direction indicated by arrow Y to an appropriate position to support the lengthwise ends of paper sheets. As the lengthwise guide member 204 is moved, the elastic unit 208 is loosened by an amount proportional to the displacement of the lengthwise guide member 204, and the angular lever 314 supported by the supporter pivots in a direction indicated by arrow Z. Accordingly, the first lever portion 314*a* of the angular lever 314 is moved downward, i.e., away from the paper pressing plate 202, and the upward pressing force of the spring 211 is diminished. Therefore, the paper pressing plate 202 is elastically biased appropriately to provide an upward pressing force against the small paper sheets.

On the contrary, when large paper sheets are used, the lengthwise guide member 204 is moved in the opposite direction of arrow Y.

Accordingly, the elastic force of the elastic unit 208 is increased, and the angular lever 314 supported by the supporter pivots in the opposite direction of arrow Z. Accordingly, the first lever portion 314*a* of the angular lever 314 is moved upward, i.e., toward the paper pressing plate 202, and the spring 211 is moved upward. Therefore, the paper pressing plate 202 is positioned appropriately to provide an upward pressing force against the relatively large paper sheets.

Figure 7:
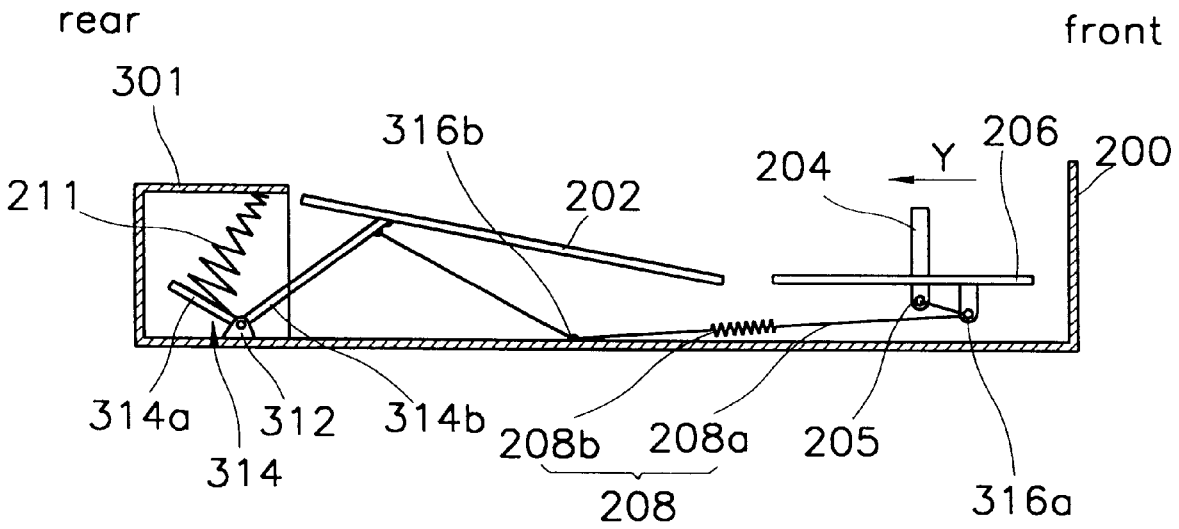
FIG. 7 is a side view schematically illustrating a portion of a fourth embodiment of a universal paper cassette according to the present invention.

FIG. 7 shows a fourth embodiment of a universal paper cassette according to the present invention.

Referring to FIG. 7, components of the present embodiment of a universal paper cassette are similar to those of the third embodiment, except that the former is further provided with two hooks and a housing 301 at the rear portion of a case 200 in the rear of the rear end of a paper pressing plate 202. The same reference numerals denote similar members having similar functions of FIG. 6.

The housing 301 is separately provided at the rear portion of the case 200, and a supporter 312, an angular lever 314 and a spring 211 are installed in the housing 301. The supporter 312 is installed on the bottom surface of the housing 301, and a second lever portion 314*b* of the angular lever 314 supported by the supporter 312 is extended to a certain length for the leading end of the second lever portion 314*b* to support the lower surface of the paper pressing plate 202. The spring 211 is installed between a first lever portion 314*a* of the angular lever 314 and an upper wall of the housing 301 . In addition, a first hook 316*a* is installed at the lower surface of a plate member 206, and a second hook 316*b* is installed at the bottom surface of the case 200 below the paper pressing plate 202. One end of an elastic unit 208 is fixed to an eyed leg portion 205 provided at a lower portion of the lengthwise guide member 204, and the other end is fixed to the second lever portion 314*b* of the angular lever 314 via the first and second hooks 316*a* and 316*b*.

In the present embodiment of a universal paper cassette as described above, when the size of paper sheets to be used is smaller than that of paper sheets being previously used, the lengthwise guide member 204 is moved in a direction indicated by arrow Y to an appropriate position to support the lengthwise ends of paper sheets. As the lengthwise guide member 204 is moved, a tension spring portion 208*b* of the elastic unit 208 extended through the first and second hooks 316*a* and 316*b* is elongated to have an elastic force. Since this elastic force counteracts that of the spring 211 via the angular lever 314, the upward pressure of the leading end of the second lever portion 314*b* against the paper pressing plate 202 is decreased, and consequentially the upward pressing force of the paper pressing plate 202 is decreased. On the contrary, when large paper sheets are used, the lengthwise guide member 204 is moved backward, in the opposite direction of arrow Y. Accordingly, the elastic unit 208 is loosened, and the upward pressure of the leading end of the second lever portion 314*b* against the paper pressing plate 202 is increased. Since the leading end of the second lever portion 314*b* presses against the paper pressing plate 202 in proportion to the elastic force of the spring 211 against the first lever portion 314*a*, feeding of large paper sheets can effectively be carried out.

Figure 8:
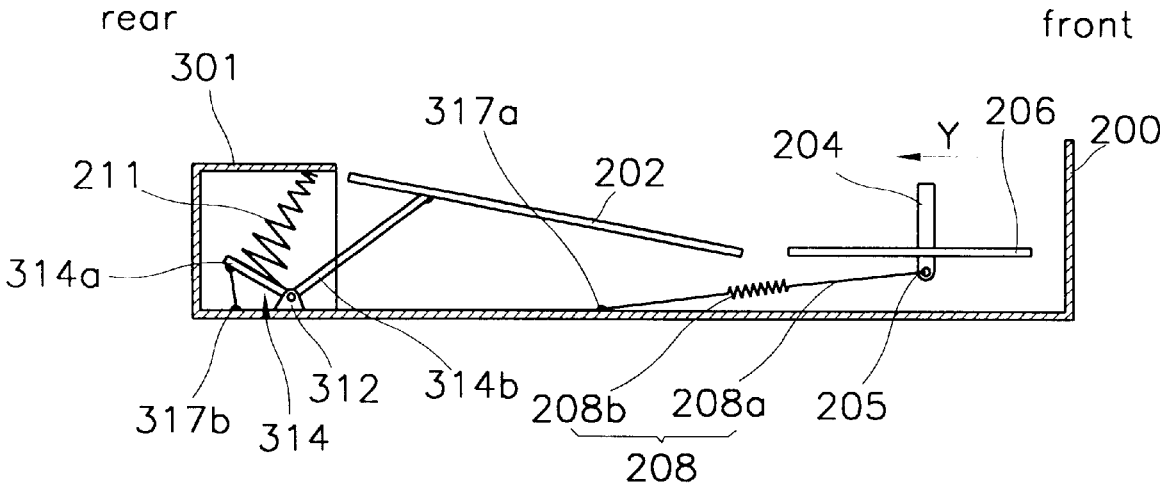
FIG. 8 is a side view schematically illustrating a portion of a fifth embodiment of a universal paper cassette according to the present invention.

FIG. 8 shows a fifth embodiment of a universal paper cassette according to the present invention.

Referring to FIG. 8, the structure of the present embodiment of a universal paper cassette are similar to that of the fourth embodiment, except that first and second hooks are provided at the bottom surface of a case 200 below a paper pressing plate 202 and at the bottom surface of a housing 301 below a first lever portion 314*a* of an angular lever, respectively, and one end of an elastic unit 208 is fixed to an eyed leg portion 205 provided at a lower portion of the lengthwise guide member 204, and the other end is fixed to the first lever portion 314*a* of the angular lever 314 via the first and second hooks 317*a* and 317*b*.

In the present embodiment, the pressure against the paper pressing plate 202 is a combined force of an elastic force of a spring 211 and an elastic force of the elastic unit 208. Therefore, when the size of paper sheets to be used is smaller than that of paper sheets being previously used, and the lengthwise guide member 204 is moved in a direction indicated by arrow Y to support the lengthwise ends of paper sheets, the elastic unit is loosened and the elastic force thereof is decreased, and accordingly the pressure of a second lever portion 314*b* of the angular lever 314 against the paper pressing plate 202 is decreased. As the pressure against the paper pressing plate 202 is decreased, the pressure of the paper pressing plate 202 against the paper sheets is decreased. When the elastic unit 208 is completely loosened, only the elastic force of the spring 211 acts on the paper pressing plate 202. Therefore, applied to the present embodiment of a universal paper cassette is a method in which after an elastic force of the spring 211 is set by taking the smallest paper sheets of usable paper sheets as a standard, the upward pressure of the paper pressing plate 202 is increased as the size of paper sheets is increased. On the contrary, when large paper sheets are used, the lengthwise guide member 204 is moved in the opposite direction of arrow Y. Accordingly, an elastic force of the elastic unit 208 is developed, and a combined force of the elastic force of a spring 211 and the elastic force of the elastic unit 208 causes the first lever portion 314*a* of the angular lever 314 to pivot downward. As a result, the second lever portion 314*b* presses the paper pressing plate 202 upward and provides an appropriate pressure corresponding to paper sizes.

On the other hand, when a resilient leaf spring is used instead of an angular lever, an elastic unit may be composed of only a wire instead of a combined member of wire portions and a tension spring portion.

A universal paper cassette according to the present invention as described above can minimize variations in pressures against paper sheets of various sizes, and therefore can effectively feed paper sheets without limitations of paper sizes by providing appropriate pressures against paper sheets according to paper size.

Although particular embodiments of the invention have been illustrated and described in detail for purposes of illustration, the invention is not limited to those embodiments. Various modifications may be made by those skilled in the art without departing from the spirit and scope of the invention.

What is claimed is:

1. A universal paper cassette, including:

a case;

a paper pressing plate pivotally installed in the case to pivot upward or downward and for receiving paper sheets on an upper surface of the paper pressing plate;

side guide members installed within the case to be slidable widthwise according to a width of the paper sheets for supporting corresponding sides of the paper sheets when received in said case;

at least one spring installed within the case for elastically biasing the paper pressing plate upward; and an elastic unit for controlling an elastic force against the paper pressing plate in accordance with a movement of the side guide members, the elastic unit having two ends, wherein one end is fixed to at least one of the side guide members and the other end is fixed to the paper pressing plate.

2. The universal paper cassette as claimed in claim 1, wherein the elastic unit further comprises a tension spring portion and wire portions, and one end of the elastic unit is fixed to a lower surface of the paper pressing plate and the other end is fixed to at least one of the side guide members via at least two hooks respectively provided at a bottom surface and an inner side surface of the case.

3. The universal paper cassette as claimed in claim 2, wherein since one end of the elastic unit is fixed to the lower surface of the paper pressing plate and the other end is fixed to the side guide member, when the side guide members are moved inward toward each other, the elastic unit is elongated and a pressure of the paper pressing plate against the paper sheets is decreased, and when the side guide members are moved outward, the elastic unit is loosened and the pressure of the paper pressing plate against the paper sheets is increased.

4. A universal paper cassette including:

a case;

a paper pressing plate pivotally installed in the case to pivot upward or downward for receiving paper sheets on an upper surface of the paper pressing plate;

a lengthwise guide member installed within the case to be slidable lengthwise according to a length of the paper sheets for supporting front ends of the paper sheets when received in the case;

at least one spring installed within the case for elastically biasing the paper pressing plate upward; and an elastic unit for controlling an elastic force against the paper pressing plate in accordance with a movement of the lengthwise guide member, the elastic unit having two ends, wherein one end is fixed to the lengthwise guide member and the other end is fixed to the paper pressing plate.

5. The universal paper cassette as claimed in claim 4, wherein the elastic unit comprises a tension spring portion and wire portions, and one end of the elastic unit is fixed to a lower surface of the paper pressing plate and the other end is fixed to the lengthwise guide member via at least two hooks provided in the case.

6. The universal paper cassette as claimed in claim 5, wherein the universal paper cassette further comprises a plate member provided with at least one elongated slot into which the lengthwise guide member is fitted for guiding the movement of the lengthwise guide member, and a hook through which one of the wire portions of the elastic unit is inserted; and wherein when the lengthwise guide member is moved toward the paper pressing plate the elastic unit is elongated and a pressure of the paper pressing plate against the paper sheets is decreased, and when the lengthwise guide member is moved away from the paper pressing plate, the elastic unit is loosened and the pressure of the paper pressing plate against the paper sheets is increased.

7. A universal paper cassette including:

a case;

a paper pressing plate pivotally installed in the case to pivot upward or downward for receiving paper sheets on an upper surface of the paper pressing plate;

a lengthwise guide member installed within the case to be slidable lengthwise according to a length of the paper sheets for supporting front ends of the paper sheets when received in the case;

at least one spring installed within the case for elastically biasing the paper pressing plate upward;

an angular lever installed on a bottom surface of the case to be capable of pivoting around a corner portion of the angular lever, and having a first lever portion to which one end of the spring is fixed, and a second lever portion extending in a direction different from the first lever portion so as to form an angle between the first and second lever portions; and an elastic unit for controlling an elastic force against the paper pressing plate by pivoting the angular lever in accordance with a movement of the lengthwise guide member, the elastic unit having two ends, wherein one end is fixed to the angular lever and the other end is fixed to the lengthwise guide member.

8. The universal paper cassette as claimed in claim 7, wherein the other end of the spring is fixed to a lower surface of the paper pressing plate; and wherein the elastic unit further comprises a tension spring portion and wire portions, and one end of the elastic unit is fixed to the second lever portion of the angular lever and the other end is fixed to the lengthwise guide member; and when the lengthwise guide member is moved toward the paper pressing plate, the elastic unit is loosened to pivot the angular lever so that a pressure of the paper pressing plate against the paper sheets is decreased, and when the lengthwise guide member is moved away from the paper pressing plate, the elastic unit is elongated to pivot the angular lever in the opposite direction so that the pressure of the paper pressing plate against the paper sheets is increased.

9. The universal paper cassette as claimed in claim 7, wherein the elastic unit comprises a tension spring portion and wire portions, and one end of the elastic unit is fixed to the second lever portion of the angular lever, and the other end is fixed to the lengthwise guide member; and wherein the second lever portion of the angular lever contacts the paper pressing plate and provides an elastic force to the paper pressing plate; and the universal paper cassette further comprises a housing by which the other end of the spring is supported, and at least two hooks provided within the case for the wire portions of the elastic unit to pass through.

10. The universal paper cassette as claimed in claim 7, wherein the elastic unit comprises a tension spring portion and wire portions, and one end of the elastic unit is fixed to the first lever portion of the angular lever, and the other end is fixed to the lengthwise guide member; and wherein the second lever portion of the angular lever contacts the paper pressing plate and provides an elastic force to the paper pressing plate; and the universal paper cassette further comprises a housing by which the other end of the spring is supported, and at least two hooks provided within the case for the wire portions of the elastic unit to pass through.

* * * * *